US006797907B1

(12) United States Patent
Meagher et al.

(10) Patent No.: US 6,797,907 B1
(45) Date of Patent: Sep. 28, 2004

(54) ROTARY SWITCH ASSEMBLY

(75) Inventors: James Meagher, Indianapolis, IN (US); Dennis Sobieck, Fishers, IN (US); Steven L. Buhrmester, Brownsburg, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/716,215

(22) Filed: Nov. 18, 2003

(51) Int. Cl.[7] ..... H01H 19/54; H01H 1/00

(52) U.S. Cl. ..... 200/564; 20/5 R; 20/8 R; 20/18

(58) Field of Search ..... 200/1 R, 1 B, 200/5 R, 5 A, 8 R, 4, 8 A, 11 R–11 TW, 18, 336, 512–517, 277–277.2, 16 C, 17 R, 553–572

(56) References Cited

U.S. PATENT DOCUMENTS 3,024,334 A * 3/1962 Rhodes ..... 200/277
3,294,929 A * 12/1966 Johnson ..... 200/11 J
3,358,093 A 12/1967 Cryer
3,686,449 A * 8/1972 Black et al. ..... 200/11 C
3,800,105 A 3/1974 Thornley
3,958,463 A 5/1976 Block et al.
3,983,355 A * 9/1976 Hyodo ..... 200/511
4,358,649 A 11/1982 Petz
4,536,628 A 8/1985 Willhaus
4,559,419 A * 12/1985 Overman et al. ..... 200/5 R
4,625,084 A * 11/1986 Fowler et al. ..... 200/11 DA
4,687,200 A 8/1987 Shirai
4,727,225 A 2/1988 Jones
4,737,608 A 4/1988 Jones
4,742,187 A * 5/1988 Sorenson ..... 200/11 J
4,918,264 A 4/1990 Yamamoto et al.
5,463,692 A * 10/1995 Fackler ..... 381/324
5,593,023 A 1/1997 Kaizaki et al.
5,967,304 A 10/1999 MacKay et al.
6,225,580 B1 * 5/2001 Lemire ..... 200/11 DA

* cited by examiner

*Primary Examiner*—James R. Scott
(74) *Attorney, Agent, or Firm*—Harness, Dickey & Pierce, P.L.C.

(57) ABSTRACT

A multi-position switch assembly mounted in a housing. The switch assembly includes a rotatable member, a set of first electrical conductors disposed along a first circumference and a set of second electrical conductors disposed on a printed circuit along at a second circumference. The switch assembly also includes an actuating mechanism that selectively provides electrical contact between at least one of the first conductors with one of the second conductors to close a circuit when the member is rotated. The first conductors may be either stationary or rotatable with the member. The actuating mechanism for the stationary conductors includes a cam, a bearing retainer and a pad with resilient buttons. The rotatable conductors are spring-biased and guided in a slot on the printed circuit board.

22 Claims, 4 Drawing Sheets

ROTARY SWITCH ASSEMBLY

FIELD OF THE INVENTION

The present invention relates to rotary multi-position electro-mechanical switches.

BACKGROUND OF THE INVENTION

Numerous designs for rotary multi-position switches are available for a variety of applications. A conventional multi-position automobile headlamp switch, for example, includes a rotor shaft with multiple cantilever springs that are attached to the shaft and provide electrical contact with their ends. When the rotor shaft is rotated to various positions, the ends of the springs open and close circuits as they come in contact, via a wiping action, with electrical conductors on the printed circuit board of the switch.

The repetitive wiping action subjects the electrical conductors to wear at high number of cycles. The conductors are also fragile and easily damaged. Therefore, improved switches that avoid direct wiping action on the conductors are still desirable.

SUMMARY OF THE INVENTION

The invention provides a multi-position switch assembly. The switch assembly includes a member rotatable about an axis of rotation, a set of first electrical conductors and a set of second electrical conductors. The second conductors are disposed on a printed board circuit at a radius from the axis of rotation. The switch assembly also includes an actuating mechanism that selectively provides electrical contact between at least one of the first conductors and one of the second conductors to close a circuit when the member is rotated.

In one embodiment, the first conductors are stationary. The actuating mechanism for the stationary conductors includes a cam, a retainer with bearings, and a pad with resilient buttons that have conductive portions that incorporate the first conductors. When the member is rotated, the cam selectively forces a bearing against one of the buttons, causing the button to deform and close an electric circuit of the switch assembly.

In another embodiment, the first electrical conductors are rotatable with the member. The actuating mechanism for this embodiment includes springs that are received in retaining portions of the member. The springs bias the first conductors in a guiding slot on the printed circuit board. In this embodiment, the second conductors are pairs of traces placed on opposite sites of the guiding slot. When the member is rotated, the first conductors come in contact with the pairs of traces at pre-determined positions and close a circuit.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF PRESENT EMBODIMENTS

The following description of present embodiments is merely exemplary in nature and is in no way intended to limit the invention, its application, or uses.

Figure 1:
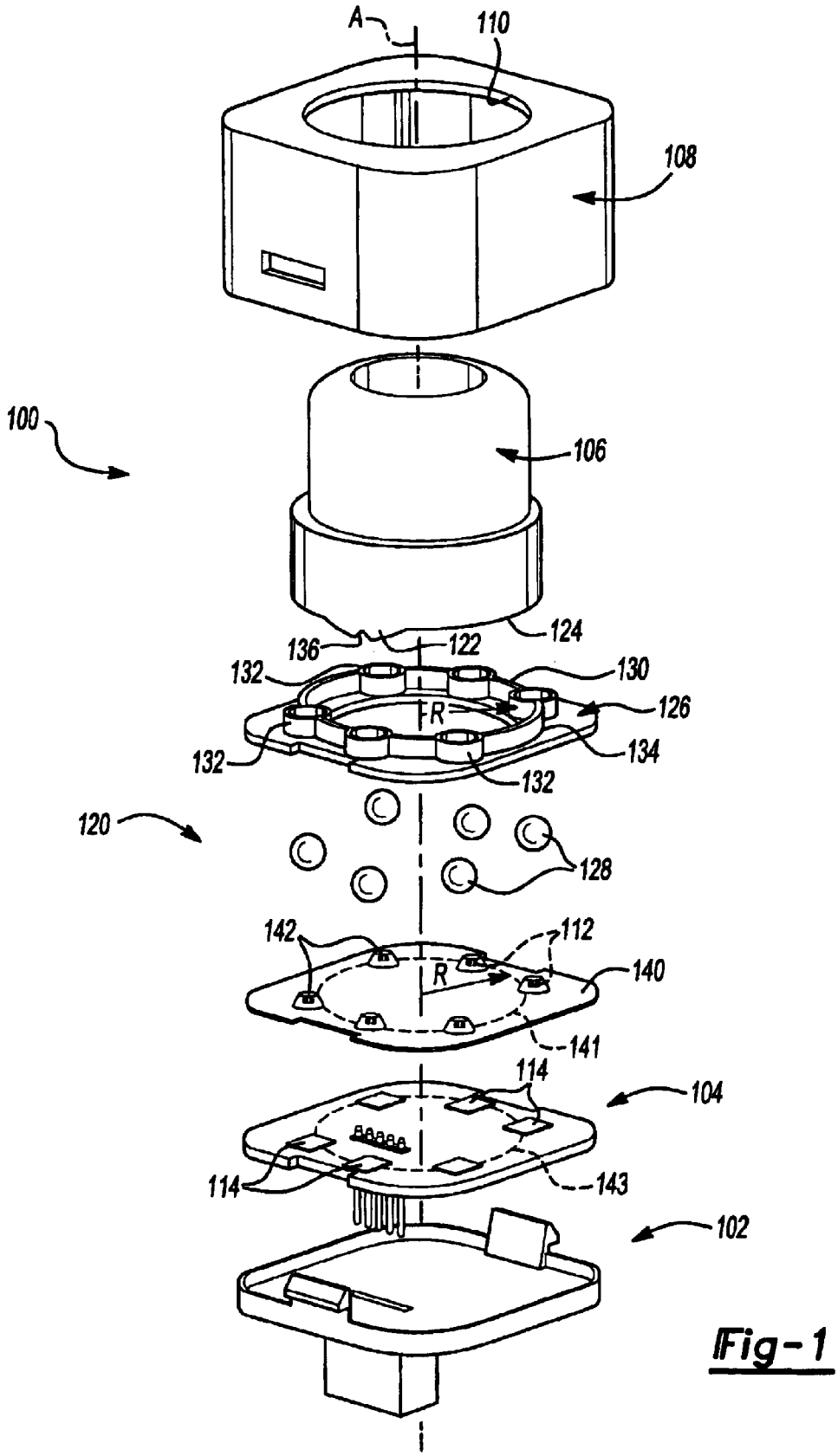
FIG. 1 is an exploded perspective view of an embodiment of a rotary switch assembly according to the present invention.
Figure 2:
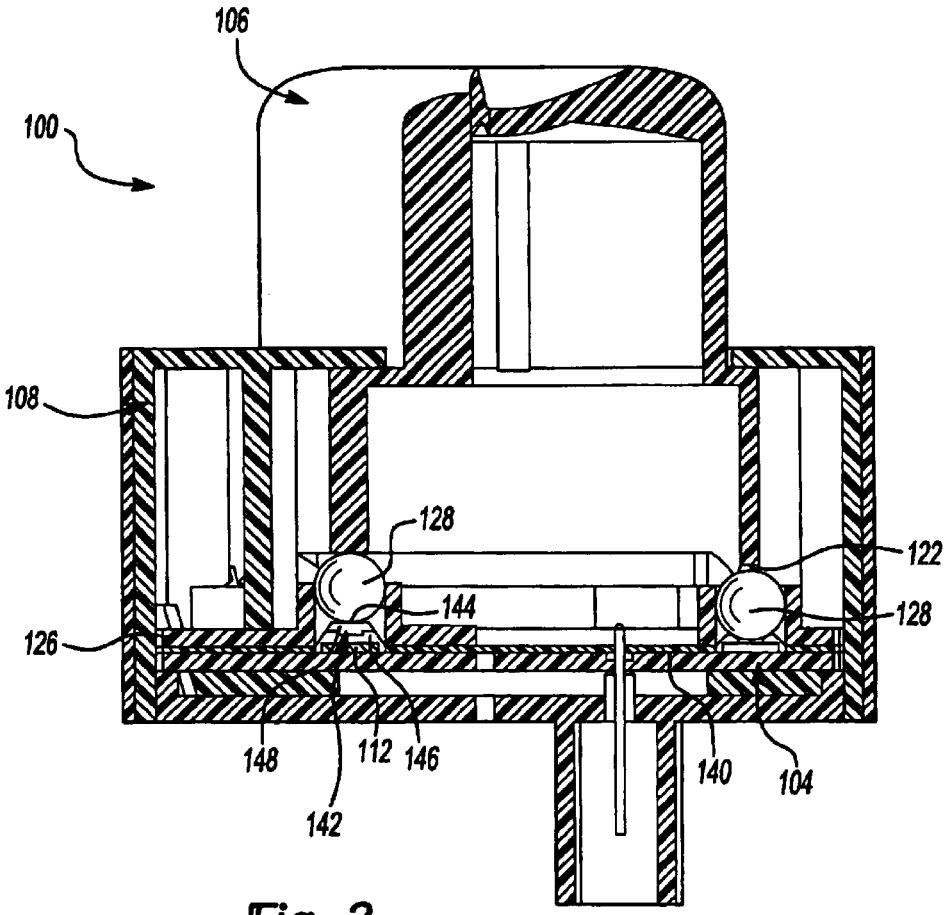
FIG. 2 is a sectional view of the switch assembly of FIG. 1.

Referring to FIGS. 1 and 2, an embodiment of the switch assembly 100 of the invention includes a base 102, a printed circuit board (PCB) 104, a member 106, such as knob or shaft, and a housing 108. The member 106 is rotatable about an axis of rotation "A". The housing 108 has an opening 110 through which a portion of the member 106 extends. The switch assembly 100 also includes a set of first electrical conductors 112 and a set of second electrical conductors 114. The electrical conductors 112, 114 are defined herein as components or portions of components, including surface treatments and material compositions that can serve as conduits of electric current. The switch assembly 100 includes an actuating mechanism, also referred herein as an actuator, which is generally designated with reference numeral 120 and includes one or more components or parts. When the member 106 is rotated to one of a number of predetermined positions, the actuator 120 causes at least of one of the first electrical conductors 112 to electrically contact one of the second electrical conductors 114, thereby closing an electric circuit that enables or disables one or more functions that are associated with the switch assembly 100 of a switch-operated appliance, or an electronic component or a product part, such as, for example, an automobile headlamp. The functions that are available may include, for example, "on" and "off" positions for the switch assembly 100, as well as specific functions, which, for a headlight switch, may include park light on, automatic day light on, etc., for example. "Closing a circuit", as used herein, is a shorthand for changing the status of the circuit from open to closed or from closed to open.

In the embodiment of FIG. 1, the actuator 120 includes a cam 122 that extends from a periphery 124 of the member 106. Although only one cam 122 is shown, two or more cams 122 may be used, such as when it is desired to close more than one circuit, for example. Multiple cams 122 may also be used to decrease the amount of rotation of the member 106 between consecutive functions of the switch assembly 100, or to effectuate two switching functions simultaneously.

The actuator 120 also includes a bearing retainer 126, which retains one or more bearings 128, such as ball bearings or other type of available bearings. The retainer 126 includes a guiding track 130 for the cam 122, and a plurality of cylindrical apertures 132, each of which can operatively house a bearing 128. The apertures 132 are arranged at a radius "R" from the rotation axis A on a circumference 134, which substantially coincides with the guiding track 130, such that two consecutive apertures 132 are circumferentially connected with a segment of the guiding track 130. In one embodiment, the cam 122 includes a notch 136, which rides on the guiding track 130 when the member 106 is rotated.

In the embodiment shown in FIG. 1, a pad 140 is positioned between the retainer 126 and the PCB 104. The pad 140 includes a plurality of buttons 142, which are resilient, such that they may deform under force, and return to their undeformed shape when the force is removed. The buttons 142 may include a flat top surface 144 and an electrically conductive portion 148, such as, for example, an insert or pill that may be received in an inner cavity 146. The conductive portions 148 incorporate the first electrical conductors 112. The buttons 142 are arranged in a predetermined spaced relationship on the pad 140 on a circumference 141 at a radius R from the rotation axis A, such that the top surfaces 144 are under the apertures 132 and in contact with the corresponding bearings 128 that are received in the apertures 132. The second electrical conductors 114 of the PCB 104 are also arranged on a circumference 143 at the same radius R from the rotation axis A, such that the second conductors 114 are located opposite the first electrical conductors 112.

The pad 140 can be made of a non-conductive, elastomeric material, such as silicon rubber. The elastomeric pad 140 together with the base 102, form an enclosure that shields the first and second electrical conductors 112, 114 from the effects of the ambient environment, such as moisture, dust, contaminants, etc. The buttons 142 may be formed integrally with the pad 140 or attached thereon. The conductive portions 148 may be inserts or pills that are plated with conductive material, such as carbon or gold, for example, and insert molded into the cavities 146 of the buttons 142 or attached to the buttons 142 by known methods. The member 106, the housing 108 and the base 102 are peferably made of a dielectric material, such as plastic, for example.

In operation, when the member 106 is rotated, the notch 136 of the cam 122 travels along the guiding track 130 until it reaches one of the bearings 128 that is housed in a corresponding aperture 132 and seated on one of the buttons 142. The cam 122 forces the bearing 128 toward the PCB 104, causing the corresponding button 142 to deform, such that the conductive portion 148 in the button 142 comes in contact with one of the second electrical conductors 114 that is located opposite the button 142, closing a circuit that corresponds to the present position of the rotatable member 106. In FIG. 2, the cam 122 is shown in engagement with the right bearing 128, and the corresponding right button 142 is shown in the deformed position that closes the circuit.

The action of the cam 122 against the bearing 128 provides a tactile feedback through the rotatable member 106 to an operator of the switch assembly 100 and indicates that a position that closes a circuit has been reached. Similarly, the deformation of the button 142, provides tactile feedback that the circuit associated with the present position is closed, and the corresponding switch function is enabled or disabled. Further rotation of the member 106 disengages the cam 122 from the bearing 128, which is pushed away from the PCB 104 by the resiliency of the button 142, as the button 142 returns to its undeformed shape. The conductive portion 148 is pulled away from the PCB 104, and contact between the first and second conductors 112, 114 is lost, returning the circuit to the open position. This procedure of cam disengagement also provides tactile feedback to the operator, as already described above.

It will be appreciated that more than one cam 122 may be included in the member 106 such that more than one circuits are closed with a single turn of the member 106. Additionally, two cams 122 may be used, for example, for reinforcing or amplifying tactile feedback. Dummy buttons, i.e. buttons that do not include conductive portions or are not opposite a second electrical conductor 114 may be provided for this purpose. Redundant buttons, i.e. buttons that operate in tandem with other buttons to close the same circuit in the event that another button fails to do so, may also be used to increase the reliability of the switch assembly 100. Many other variations or combinations of the arrangement of the buttons 142, the cam 122 and the retainer 126 of this embodiment will be within the purview of the artisan of ordinary skill for achieving a particular result in a particular application.

Figure 3:
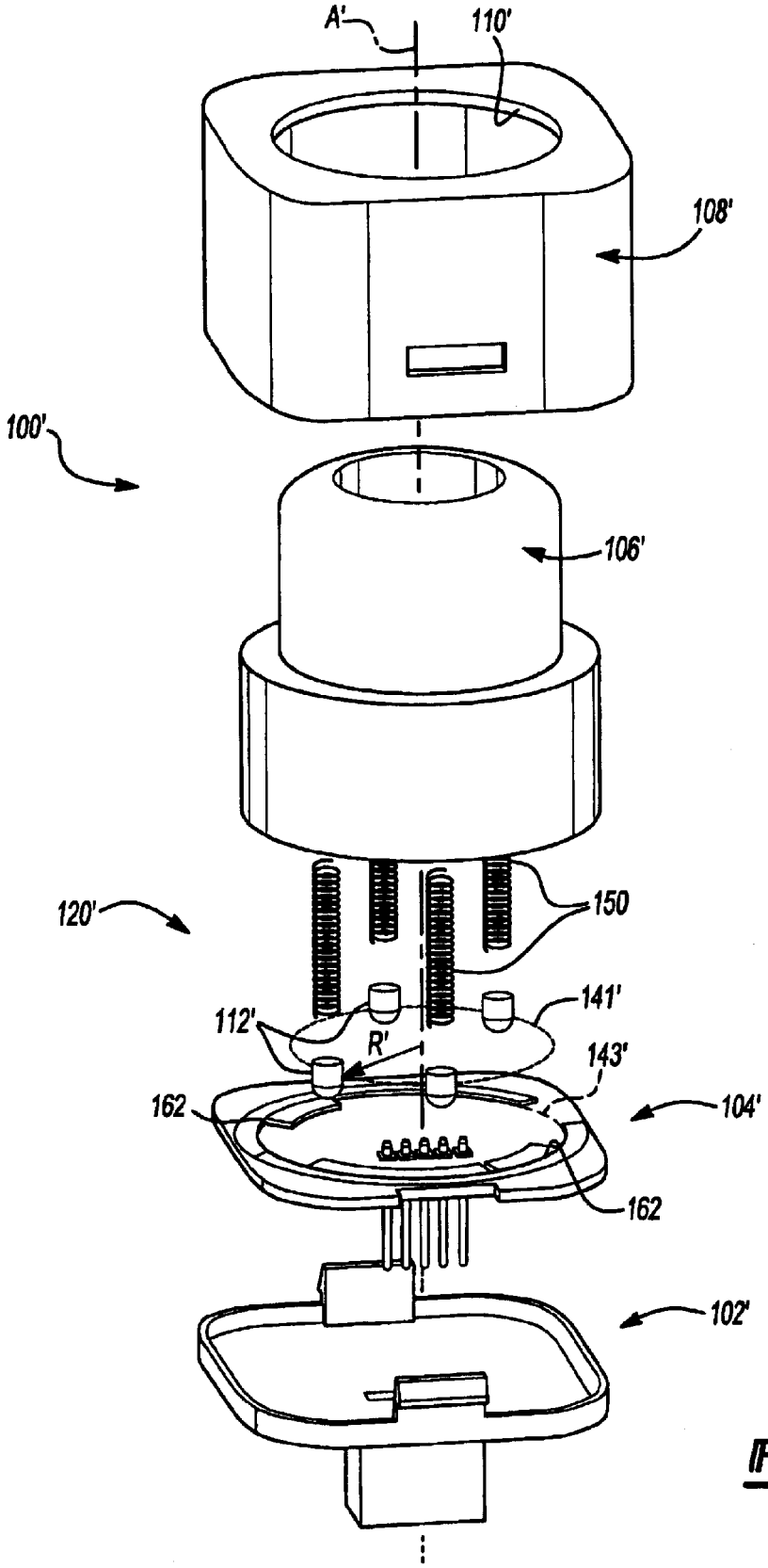
FIG. 3 is an exploded perspective view of an embodiment of a rotary switch assembly according to the present invention.
Figure 4:
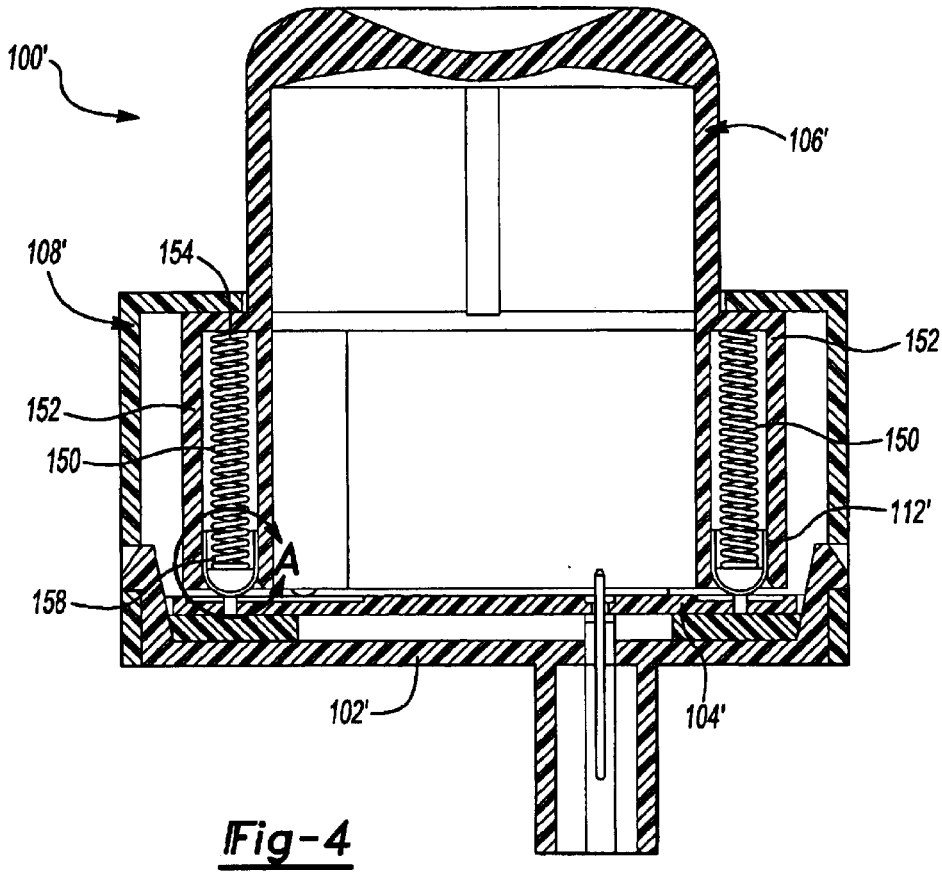
FIG. 4 is a sectional view of the switch assembly of FIG. 3.
Figure 5:
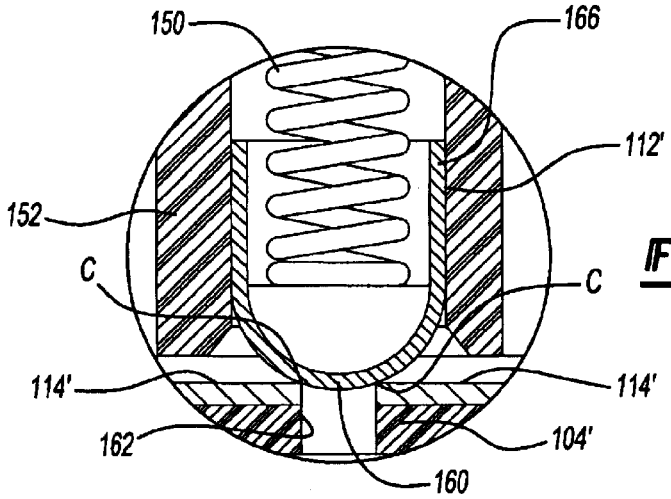
FIG. 5 is an enlarged view of detail A of FIG. 4.

Another embodiment of the multi-position switch assembly 100' is illustrated in FIGS. 3–5. Elements and features common to both embodiments shown in the Figures are identified with like reference numerals, and their detailed description will not be repeated. In the embodiment of FIG. 3, the actuating mechanism 120' includes a plurality of first electrical conductors 112', which are disposed along a circumference 141' at a radius R' from the axis of rotation A' and are biased with springs 150. The springs 150 are received in retaining portions 152, which are incorporated in the structure of the member 106'.

Each of the first electrical conductors 112' has a tubular portion 166 and an end portion 160. The tubular portion 166 is received in one of the retaining portions 152. The end portion 160 is shaped to be received in a circumferential guiding slot 162 in the PCB 104'. Referring to FIG. 5, the second electrical conductors are pairs of traces 114' circumferentially arranged on the PCB 104' on each side of the slot 162 corresponding to pre-selected locations of the member 106'. When the end portion 160 of one of the first electrical conductors 112' contacts both traces 114' of a pair at points "C" on each side of the slot 162, an electric circuit associated with the corresponding position of the switch assembly 100' closes.

Each spring 150 has a first end 154 that is adjacent to the member 106' and a second end 158 that is adjacent to the end portion 160 of one of the first electrical conductors 112', such that the spring 150 is held between the retaining portion 152 and the end portion 160. In other embodiments, the first end 154 of the spring 150 may be attached to the member 106', or the second end 158 of the spring 150 may be attached to the first electrical conductor 112'.

The first electrical conductors 112' may, for example, be deep-drawn from cartridge brass, and then silver plated. The end portions 160 may be hemispherical. The electrically conductive traces 114' on the PCB 104' may be made from copper and silver plated. The compression springs 150 are preferably selected to have very low spring rate, such that contact is easily achieved without relying on high forces that may cause excessive mechanical wear resulting in intermittent switch operation. The compression springs 150 and the first electrical conductors 112' are easily removable and can be replaced and/or re-used in other switches.

It will be appreciated that the switch assembly 100, 100' of the invention is easily assembled from a small number of parts, thereby reducing manufacturing costs while increasing reliability. Each circuit-closing contact, i.e. contact between the first and second electrical conductors 112 (112'), 114(114'), is independent of any of the other circuit-closing contacts, resulting in better reliability. Redundant circuit-closing contacts are easily provided and also contribute to increased reliability and quality of the switch assembly 100, 100'.

While various embodiments of the invention have been described, it will be apparent to those of ordinary skill in the art that other embodiments and implementations are possible that are within the scope of this invention. According, the invention is not restricted except in light of the attached claims and their equivalents.

What is claimed is:

1. A rotary switch assembly comprising:

a rotatable member comprising a cam;

a retainer coupled to the rotatable member;

a bearing housed in the retainer;

a pad comprising a resilient button, the button having an electrically conductive portion;

a base; and a printed circuit board retained in the base and having an electrical conductor, such that upon rotation of the rotatable member, the cam selectively forces the bearing to compress the button and close a circuit by bringing the conductive portion into electrical contact with the conductor.

2. The switch assembly of claim 1, wherein the pad and the base provide an enclosure shielded from an ambient environment.

3. The switch assembly of claim 1, further comprising a housing connected to the base and having an opening through which a top portion of the rotatable member extends.

4. The switch assembly of claim 1, wherein the retainer includes a cylindrical aperture at least partially receiving the bearing and the button.

5. The switch assembly of claim 4, wherein the bearing moves relative to the aperture in a first direction when the button is compressed and in a second direction when the is released.

6. The switch assembly of claim 5, wherein the pad includes a track for guiding the cam toward and away from the aperture.

7. The switch assembly of claim 6, wherein the circuit opens when the cam guiding away from aperture and releases the button.

8. The assembly of claim 7, wherein the button provides tactile feedback through the rotatable member when the circuit closes and opens.

9. A switch assembly for actuating a plurality of electrical circuits, the assembly comprising:

a rotatable member comprising a cam;

a retainer coupled to the rotatable member and housing a plurality of bearings;

a pad including a plurality of resilient buttons, each button having a conductive portion and a surface that is in contact with a corresponding bearing;

a base supporting the pad; and a printed circuit board retained in the base and having a plurality of electrical conductors, such that upon rotation of the rotatable member, the cam selectively forces one of the bearings to compress the corresponding button and close one of the circuits by bringing the conductive portion of the button in electrical contact with the corresponding conductor.

10. The assembly of claim 9, wherein at least one of the electrical conductors is redundant.

11. The assembly of claim 9, wherein at least one of the buttons is redundant.

12. The assembly of claim 9, wherein the circuits are closed in a predetermined sequence.

13. A multi-position switch assembly comprising:

a rotatable member having a cam;

a bearing retainer having a plurality of apertures;

a plurality of bearings, each bearing received in a corresponding aperture and being in contact with a corresponding resilient button, the button being supported on a printed circuit board, wherein upon rotation of the member, the cam selectively compresses one of the bearings to cause the corresponding button to close a circuit.

14. The switch assembly of claim 13, wherein one of the buttons is redundant.

15. A multi-position switch assembly mounted on a base, the switch assembly comprising:

a member rotatable relative to the base;

a printed circuit board received in the base and comprising a slot;

a plurality of first electrical conductors rotatable with the member, wherein each of the first electrical conductors comprises a tube having a longitudinal axis and terminating in a closed end that is biased toward the slot along the longitudinal axis; and a plurality of pairs of second electrical conductors disposed on opposing sides of the slot, such that upon rotation of the member, at least one of the first conductors contacts one of the pairs of the second conductors and closes a circuit of the switch assembly.

16. The multi-position switch assembly of claim 15, wherein the closed end is hemispherical.

17. The multi-position switch assembly of claim 15, wherein each of the first electrical conductors is received in a retaining portion of the rotatable member.

18. The multi-position switch assembly of claim 17, further including a plurality of springs, wherein each spring is received in one of the retaining portions and has one end received in the tube of the corresponding first electrical conductor.

19. The multi-position switch assembly of claim 15, wherein one of the first electrical conductors redundant.

20. The multi-position switch assembly of claim 15, further comprising a housing attached to the base and having an opening through which the member extends.

21. The multi-position switch assembly of claim 15, wherein one of the second electrical conductors redundant.

22. A multi-position switch assembly mounted on a base, the switch assembly comprising:

a member rotatable relative to the base, the member including a plurality of retaining portions;

a plurality of first electrical conductors, each first electrical conductor comprising a tube terminating in a hemispherical end, wherein each of the tubes is received in one of the retaining portions of the member;

a plurality of springs received in the retaining portions of the member, each spring having one end received in the tube of the corresponding first electrical conductors;

a printed circuit board supported on the base and including a guiding slot sized to receive a portion of the hemispherical end of each of the first electrical conductors; and a plurality of pairs of second electrical conductors disposed on opposing sides of the guiding slot, such that upon rotation of the member, at least one of the hemispherical ends contacts each of the second conductors of one pair and closes a circuit of the switch assembly.

* * * * *

UNITED STATES PATENT AND TRADEMARK OFFICE

CERTIFICATE OF CORRECTION

PATENT NO. : 6,797,907 B1 
DATED : September 28, 2004
INVENTOR(S) : James Meagher et al.

It is certified that error appears in the above-identified patent and that said Letters Patent is hereby corrected as shown below:

Column 5,
Line 28, after "the" insert -- button --.
Line 33, "guiding" should be -- moves --.
Line 33, after "from" insert -- the --.

Column 6,
Lines 36 and 41, after "conductors" insert -- is --.
Line 53, "conductors" should be -- conductor --

Signed and Sealed this

First Day of February, 2005

JON W. DUDAS
*Director of the United States Patent and Trademark Office*